United States Patent [19]

Perini

[11] Patent Number: 4,744,323

[45] Date of Patent: May 17, 1988

[54] HELM STEERING GEAR

[76] Inventor: Fabio Perini, Via Fornace, S. Michele di Moriano, Lucca, Italy

[21] Appl. No.: 62,743

[22] Filed: Jun. 16, 1987

[30] Foreign Application Priority Data

Jun. 18, 1986 [IT] Italy ..... 9421 A/86

[51] Int. Cl.[4] ..... B63H 25/00

[52] U.S. Cl. ..... 114/144 R

[58] Field of Search ..... 114/144 R, 154, 155, 114/156, 157, 158, 159, 160, 165; 74/480 B, 491, 492

[56] References Cited

U.S. PATENT DOCUMENTS 3,815,537 6/1974 Evans ..... 114/144 R

FOREIGN PATENT DOCUMENTS 27890 4/1932 Netherlands ..... 114/144 R

*Primary Examiner*—Joseph F. Peters, Jr.
*Assistant Examiner*—Jesûs D. Sotelo
*Attorney, Agent, or Firm*—Francis J. Bouda

[57] ABSTRACT

A helm steering wheel for a sea-going vessel is mounted on the back of the wheel-support so that the instruments on the support are fully visible and not obstructed by the passing of the spokes of the wheel. The wheel is in the shape of a concave dish and rotates on an axle which is mounted in the support so that the support is between the wheel-hub and the operator and positioned so that the rim of the wheel is closely adjacent the operator standing in front of the support.

6 Claims, 2 Drawing Sheets

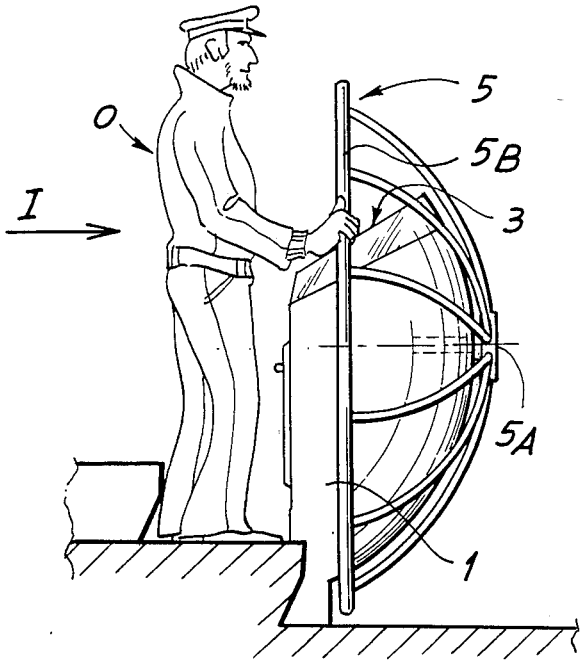
Fig. 1
Fig. 2
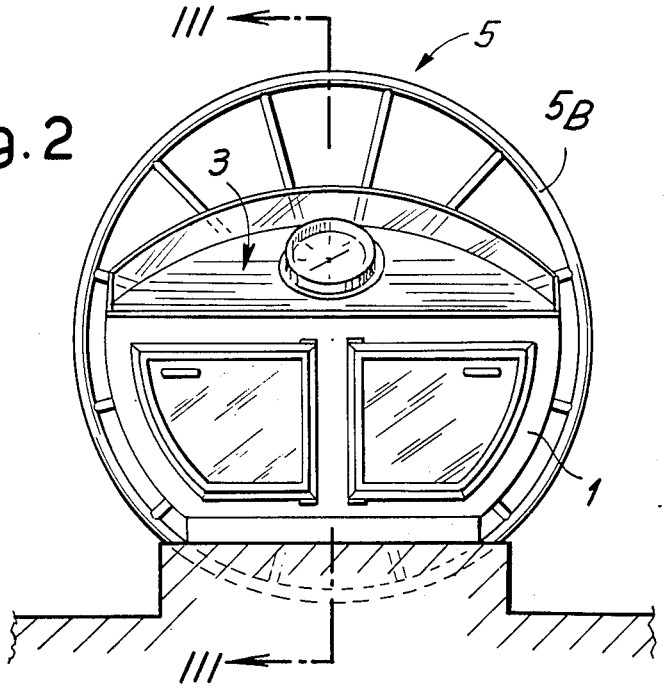

HELM STEERING GEAR

BACKGROUND OF THE INVENTION

The helm-steering gear or wheel-steering mechanism for sea-going vessels has historically been mounted on a support so that the wheel is disposed vertically on the stern-side of the support, and in a position where the helmsman or operator can stand behind the wheel for easy manipulation of the wheel while facing forward.

Unfortunately, this disposition of the device means that the wheel-spokes or arms are between the helmsman and the support, and any instruments or controls or indicators or the like are generally obstructed by the passing of the spokes or arms of the wheel.

SUMMARY OF THE INVENTION

In the present invention, the steering wheel is mounted on the forward side of the support, and the hub of the wheel is fastened to an axle which extends rearwardly toward the stern of the vessel. The support has a hemi-spherical projection extending forwardly, and the wheel is concave in shape so as to envelop in a rearwardly-extending direction, the hemispherical portion of the support. Thus the wheel has a concave development toward the helmsman so as to embrace the support and present the rim of the wheel in an ideal position to be held by the operator who stands rearwardly of the support.

With such an arrangement, the display of instruments on the support is completely visible and, in addition, because the helmsman stands close to the support, he may fasten himself thereto in stormy weather, or lean against it for additional support, while handling the wheel in stormy weather. Although the wheel is preferred to be in a cup shape, it is understood that other shapes which are more angular can be arranged, such as a conical shape.

It is preferred that the support be arranged so that the surface thereof is generally close to the rim of the wheel as will be described in more detail hereafter.

Although the axis of the steering wheel will generally be horizontal with the rim of the wheel therefor rotating in a vertical plane, the invention is not so limited, and the axis may be inclined with respect to the horizontal; and, furthermore, the support can be inclined or moved about a transverse axis.

Therefore, an object of the present invention is to provide a helm steering gear with a structure for supporting the wheel in such a manner that instruments mounted on the support are clearly visible.

Another object is to provide a steering arrangement for a sea-going vessel wherein the support for the wheel is between the spokes, ribs, or arms of the wheel, and the helmsman.

Another object is to provide a support for the wheel of a sea-going vessel whereby the helmsman can secure himself to the support, if desired.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 1 is a vertical side elevational view of the helm steering wheel of the present invention with an idealized picture of the helmsman standing in position at the wheel.

FIG. 2 is a front elevational view showing the helm steering wheel of the present invention and clearly illustrating how the instrument panel is unobstructed by the spokes of the wheel.

Figure 3:
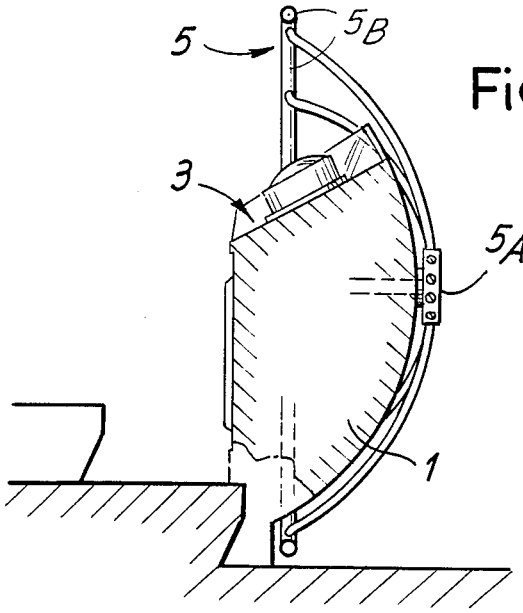
FIG. 3 is a section view taken generally along line III—III of FIG. 2.

In the attached drawing, numeral 1 indicates the support structure of the helm steering gear, which structure forms a dashboard or instrument panel 3 for various instruments which are to be readily and clearly visible by the helmsman or operator O standing at the steering wheel.

In traditional arrangements of steering gear, the steering wheel is mounted between the operator and the support structure while the operator standing at the steering wheel, and the arms or spokes of the steering wheel partially or intermittently obstruct the dashboard or other instrument panel 3. This is avoided by the arrangement according to the present invention.

Accordingly, the hub 5A of the steering wheel generally indicated by 5, is mounted on the forward side of the support (this being the "back" of the support with respect to the operator O), and thus is also on the backside of the panel or dashboard 3.

In order to insure the correct position of the rim or handling ring 5B of wheel 5, the latter is cup-shaped with curved arms (rims or spokes), as shown in the drawing, so as to present the rim of the wheel closer to the operator who stands on the stern-side or "front" of the support 1.

The support 1 has a hemispherical portion on the forward side thereof, shaped to follow the outline of the wheel, and which, being concave in its development, advantageously follows the surface of the spherical portion of the support 1.

The support 1 may be in the nature of a cabinet with appropriate doors facing the helmsman for storing of appropriate gear, and also the support shall include the appropriate mechanism (not shown) for transmitting the angular displacement of the wheel 5 to the rudder either by mechanical or hydraulic, or any other suitable means.

It is apparent from the foregoing description that this arrangement provides that the instrument panel 3 is perfectly visible to the helsman standing at the steering wheel, without any obstacle provided by the wheel, spokes, or arms. Additionally, the helmsman can lean against the support 1 and can tie himself thereto in stormy weather.

Figure 4:
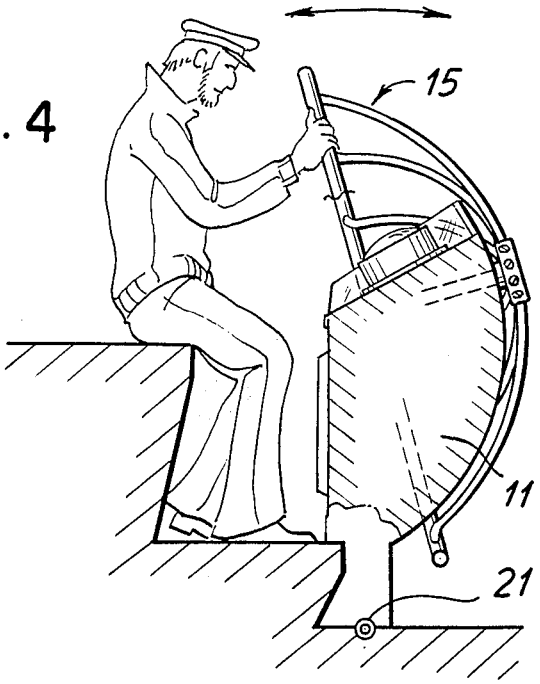
FIG. 4 is a vertical cross-sectional view similar to that of FIG. 3 but illustrating how the wheel and its axle may be mounted in the support at an inclined position so as to provide for easy handling by a seated helmsman.

Generally speaking, the steering wheel will have a horizontal axis so that the rim of the wheel rotates in a vertical plane, but it may also be arranged with an inclined axis as shown in FIG. 4, wherein the wheel 15 has its axis inclined so as to present the upper part of the periphery of the rim of the wheel toward the helmsman in a more convenient position.

With the arrangement shown in FIG. 4 or, alternately, in the previous arrangement shown in FIGS. 1–3, it is also possible to provide the support 1 with a pivot 21 so that the support may be articulated, i.e., tilted forward or aft, as desired.

It is to be understood that the present invention may be embodied in other specific forms without departing from the spirit or special attributes hereof, and it is herefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. A helm steering gear for a sea-going vessel, said steering gear having a support and a wheel, said wheel mounted on said support with the hub of said wheel on the forward side of the support, and with said wheel having a concave shape with arms thereof extending toward the stern of the vessel and toward the helmsman, and thus embracing the support and presenting the peripheral rim of the wheel in a position closer to the helmsman.

2. A helm steering gear of claim 1 wherein the wheel is cup-like in shape, providing an outline or envelope which is hemispherical in nature.

3. A helm steering gear of claim 1 wherein the support has a hemispherical portion extending forwardly and into the concavity of the wheel so that the arms of said wheel pass closely adjacent the outer surface of the surface of the support.

4. The helm steering gear of claim 1 wherein the axis of the steering wheel is generally horizontal.

5. The helm steering gear of claim 1 wherein the axis of the steering wheel is inclined with respect to a horizontal plane.

6. The helm steering gear according to any of the preceding claims wherein the support is mounted on a pivot so that the support can be inclined about a transverse axis.

* * * * *